US005253771A

United States Patent [19]

Mikulas, Jr. et al.

[11] Patent Number: 5,253,771

[45] Date of Patent: Oct. 19, 1993

[54] COUNTER-BALANCED, MULTIPLE CABLE CONSTRUCTION CRANE

[75] Inventors: Martin M. Mikulas, Jr.; Li-Farn Yang, both of Boulder, Colo.

[73] Assignee: The United States of America as represented by the Administrator of the National Aeronautics and Space Administration, Washington, D.C.

[21] Appl. No.: 793,974

[22] Filed: Nov. 18, 1991

[51] Int. Cl.[5] ..... B66C 23/76

[52] U.S. Cl. ..... 212/148; 212/196; 212/262

[58] Field of Search ..... 212/146, 147, 148, 182, 212/195, 196, 239, 259, 260, 262, 265

[56] References Cited

U.S. PATENT DOCUMENTS

| | | | |
|---|---|---|---|
| 3,107,791 | 10/1963 | Michael | 212/148 |
| 3,567,040 | 3/1971 | Thomson | 212/148 |
| 3,685,669 | 8/1972 | Morrison | 212/148 |
| 3,945,508 | 3/1976 | Colin | 212/148 |
| 4,155,463 | 5/1979 | Buzzichelli et al. | 212/196 |
| 4,664,271 | 5/1987 | Evans | 212/196 |
| 4,932,541 | 6/1990 | Belsterling | 212/148 |

*Primary Examiner*—David M. Mitchell
*Assistant Examiner*—Stephen P. Avila
*Attorney, Agent, or Firm*—Kevin B. Osborne; George F. Helfrich

[57] ABSTRACT

The invention is a counter-balanced, multiple cable construction crane. The apparatus for hoisting payloads comprises a crane having a lifting segment and a counter-balanced segment. The lifting segment comprises an end effector and three cables. One end of each cable attaches to a different winding device located on the lifting segment, and the other end of each cable attaches to a different point on the end effector, such that the three cables have a theoretical point of convergence, this point corresponding with a center of mass of the payload. Three controls command rotation of the winding device to a predetermined position. Accordingly, the crane provides precise and autonomous positioning of the payload without human guidance. Two controls position the counter-balancing segment to offset the overturning moment which arises during the lifting of heavy payloads.

15 Claims, 11 Drawing Sheets

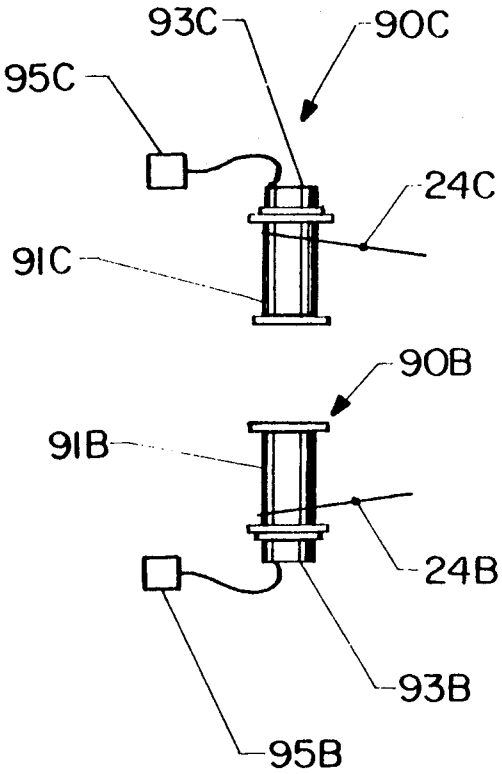
FIG 9(B)
FIG 9(C)
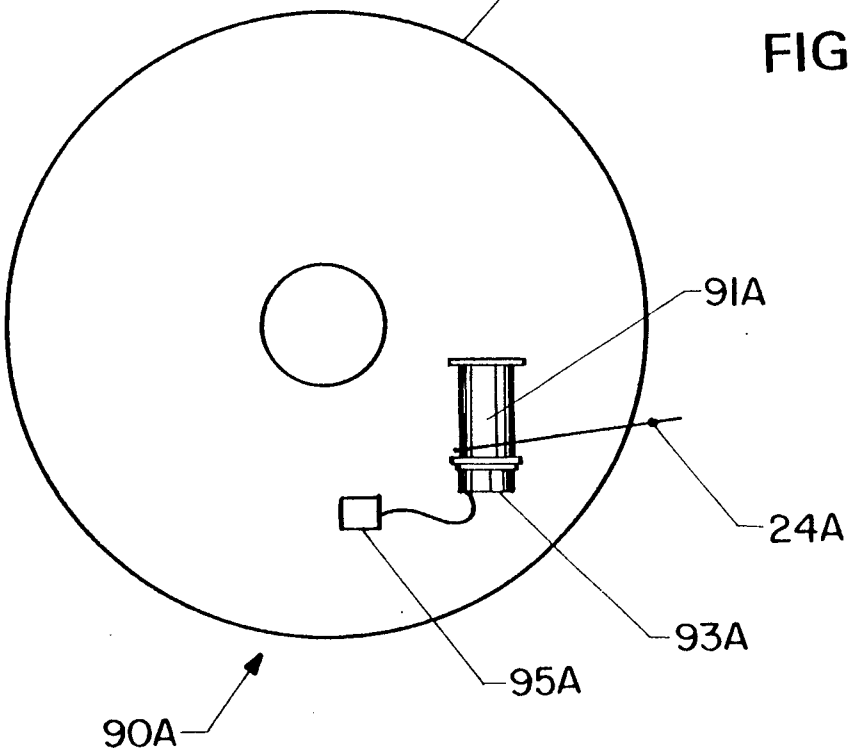
FIG 9(A)

COUNTER-BALANCED, MULTIPLE CABLE CONSTRUCTION CRANE

ORIGIN OF THE INVENTION

The invention described herein was jointly made by an employee of the United States Government and in the performance of work under NASA Grant No. NAG-W-1388. In accordance with 35 USC 202, the grantee elected not to retain title.

BACKGROUND OF THE INVENTION

1. Field of the Invention

The present invention relates generally to cranes and more specifically to counter-balanced cranes with multiple suspension cables to provide stable and precise positioning of a payload.

2. Description of Related Art

Earth-based construction typically involves a large crane with a single vertical support cable which positively controls only a single degree of freedom of a payload. Laborers control the other five degrees of freedom by holding onto the payload with guy lines. Thus, human guidance is necessary for accurate positioning of the payload.

Future space missions to the Moon or to the planets will likely demand a construction crane for unloading large, massive modules from a landing site and relocating them to designated areas for construction into an operational base. The presence of astronauts for these operations will be limited because of the remoteness of these bases. Thus, the cranes designed for the unloading and moving of these modules must be capable of highly stable, precise, automated operations.

Dagalakis et al disclose in NIST Technical Note 1267 (July 1989) a design for a crane employing six suspension cables that attach to the payload. This art has the advantage of allowing positive control of all six of the degree of freedom of the payload, but has the disadvantage of requiring control of all six cables to provide precise, automated operations.

Another disadvantage of the prior art relates specifically to mobile, construction cranes. Mobile cranes require a large mass to offset the tipping moment created by lifting heavy payloads. For example, a cursory study of typical mobile cranes reveals that the ratio of the operational distance of the crane to the distance between the center of gravity of the crane and its point of tipping is typically on the order of three or four to one. Therefore, a crane designed to lift a payload of 60,000 pounds with a distance ratio of four must weigh 240,000 pounds. On Earth, such machine weight to payload weight ratios are acceptable because machine weight does not significantly affect cost. However, for planetary missions, weight is a major factor in the costs encountered for launching and thus must be reduced. Compact stowage is another design goal for cranes used in planetary missions.

SUMMARY OF THE INVENTION

An object of the present invention is to provide precise and autonomous positioning of a payload without the aid of human guidance.

Another object of the present invention is to provide precise and autonomous positioning of a payload without the use of elaborate, complicated controls.

A further object of the invention is to reduce the large crane weight necessary to offset the overturning moment which occurs when a crane lifts a heavy payload.

The present invention attains the foregoing and additional objects by providing an apparatus for hoisting and moving a payload having a center of mass. The apparatus comprises a crane having a lifting means. The lifting means comprises an end effector and three cables. One end of each cable attaches to a different point on the lifting means, and the other end of each cable attaches to a different point on the end effector, such that the three cables point toward a convergence, which corresponds with the center of mass of the payload. The crane further comprises a counter-balancing means. Two controls position the counter-balancing means to offset the overturning moment which arises during the lifting of heavy payloads.

Preferably, the crane further comprises a foundation. The foundation supports the lifting and the counter-balancing parts of the crane. A transporting means such as a carriage connects to the bottom of the foundation and thereby facilitates mobility of the crane.

The lifting means preferably further comprises three controls to position the three cables. The three cables each attached to a different winding mechanism, and the three controls command rotation of the winding mechanism to a predetermined position. Accordingly, the crane provides precise and autonomous positioning of the payload without the aid of human guidance.

BRIEF DESCRIPTION OF THE DRAWINGS

FIGS. 9(A), 9(B) and 9(C) are respective top views of three winding mechanisms of the present invention;

DESCRIPTION OF THE PREFERRED EMBODIMENT

Figure 1:
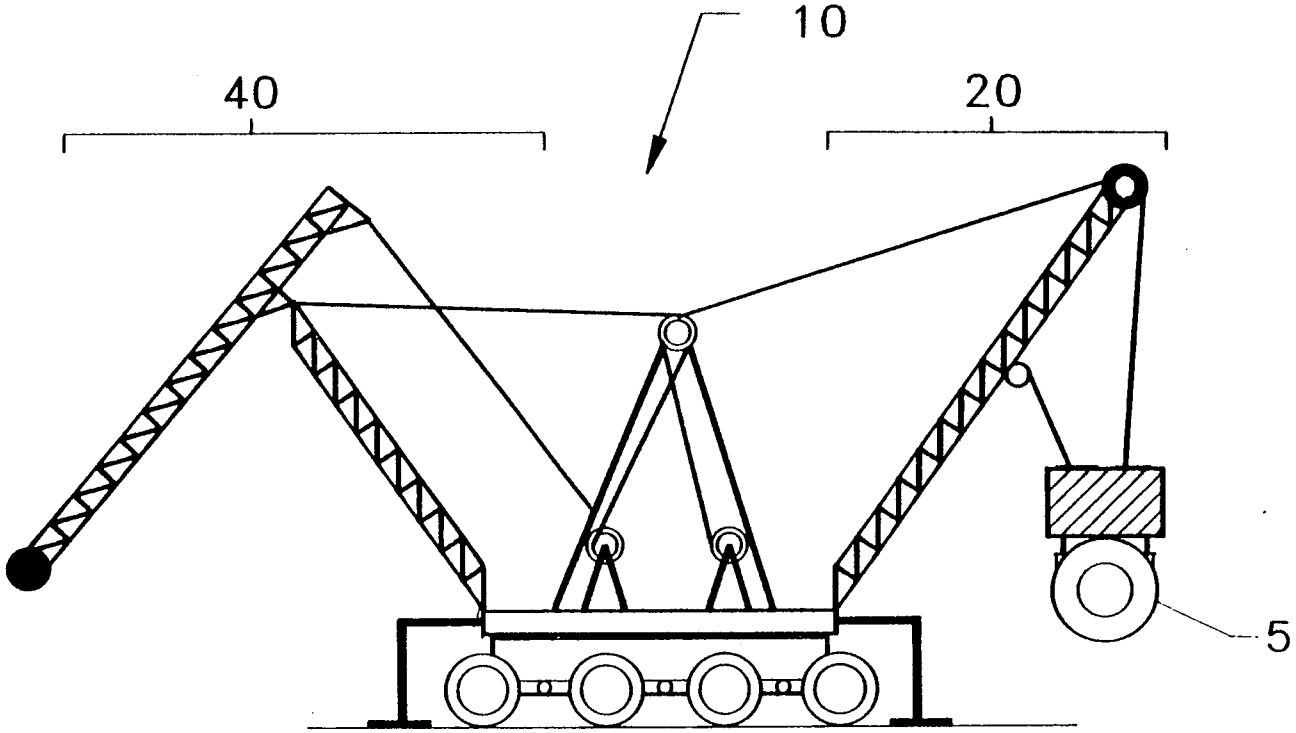
FIG. 1 is a side view of a counter-balanced crane with multiple suspension cables according to the present invention.
Figure 2:
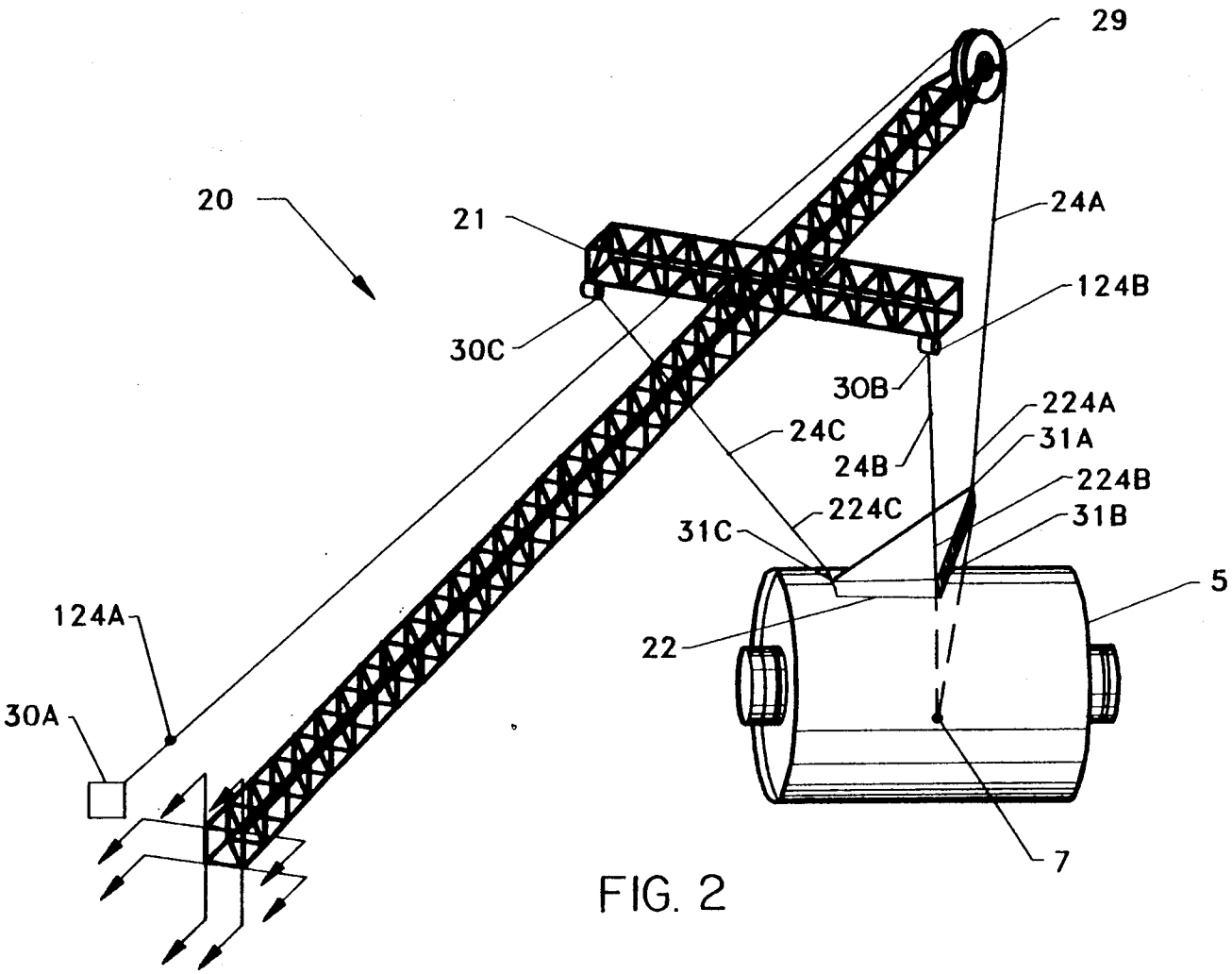
FIG. 2 is a perspective view of a lifting means of the crane showing the preferred arrangement of suspension cables.

FIG. 1 shows a crane 10 comprising a lifting means 20 and a counter-balancing means 40. The crane 10 typically hoists and moves a payload 5. As shown in FIG. 2, lifting means 20 comprises a third boom 21, an end effector 22, and three cables 24A, 24B, and 24C. Each cable 24A, 24B, and 24C has respectively a winding end 124A, 124B, and 124C and has respectively a working end 224A, 224B and 224C. Each winding end 124A, 124B, and 124C respectively attaches to different points 30A, 30B, and 30C of the lifting means 20, and each working end 224A, 224B, and 224C respectively attaches to different points 31A, 31B, and 31C of the end effector. The points 31A, 31B, and 31C are located such that the three cables 24A, 24B, and 24C have a theoretical point of intersection 7 which coincides with the center of mass 7 of the payload 5. Preferably, one of the three cables supports approximately 90% of the load, while the other two cables serve as guide cables in hoisting and moving the payload.

The cable arrangement of the present invention provides position control of the three translational degrees of freedom of the payload, and also provides geometric nonlinear stiffness for the three rotational degrees of freedom of the payload. This arrangement also results in the highest natural frequency of the cable/payload system and thereby provides a controllable, precise system for positioning of the payload.

Figure 3:
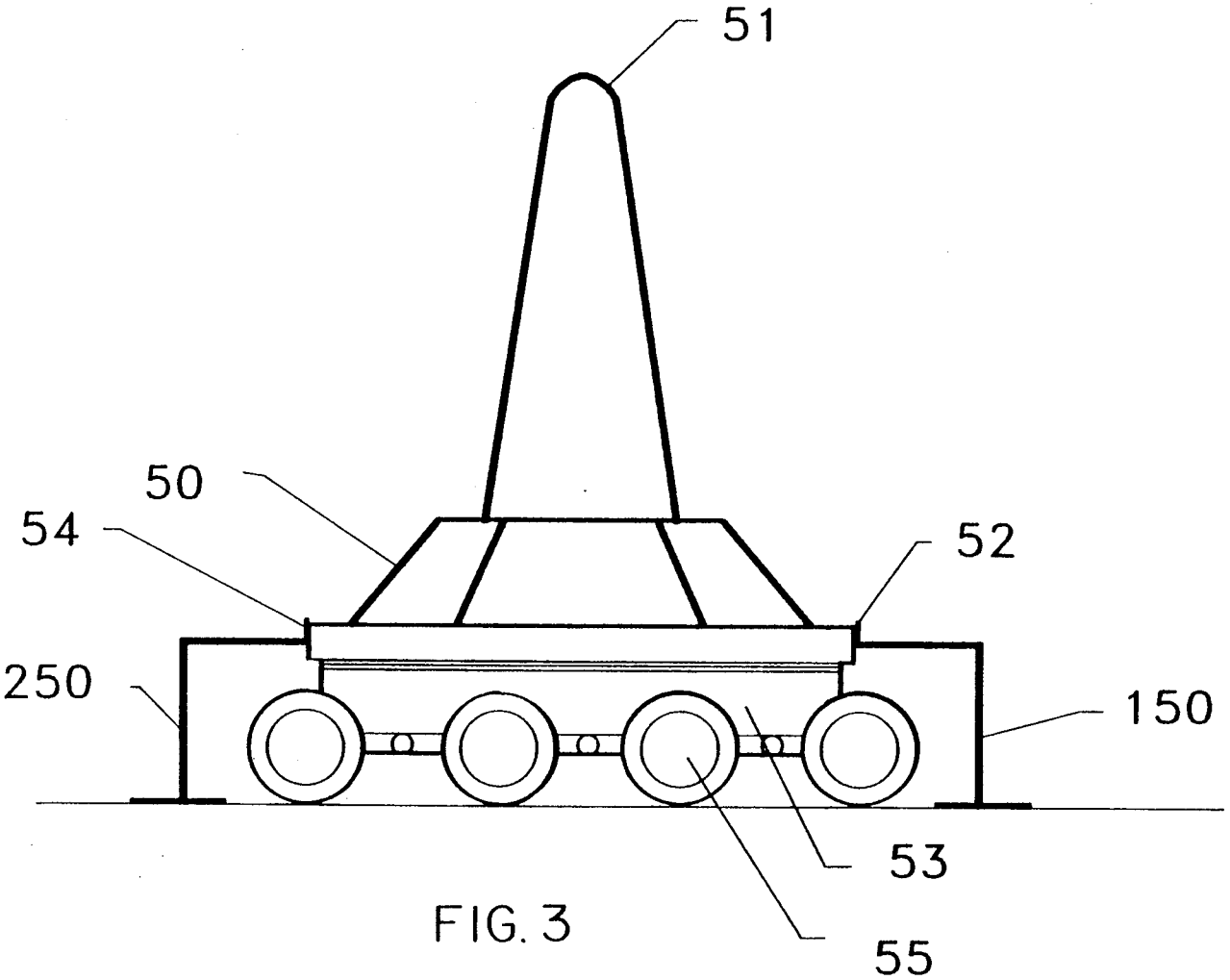
FIG. 3 is a side view of a foundation and a transporting means of the present invention.

As illustrated in FIG. 3, a foundation 50, having a top 51, a bottom 53, and two opposite ends 52 and 54, supports the lifting means 20 and the counter-balancing means 40 of crane 10. Preferably, the lifting means 20 attaches to one of the two opposite ends 52 and 54, and the counter-balancing means 40 attaches to the opposite end which is not attached to the lifting means 20. This attachment scheme maximizes the counter-balancing moment available to offset the heavy-load tipping moment of crane 10.

A transporting means 55 such as a carriage connects to the bottom 53 of the foundation 50 and thereby facilitates mobility of crane 10 across a lunar or planetary surface. Stabilizers 150 and 250 add support and stability to crane 10 during hoisting.

Figure 4:
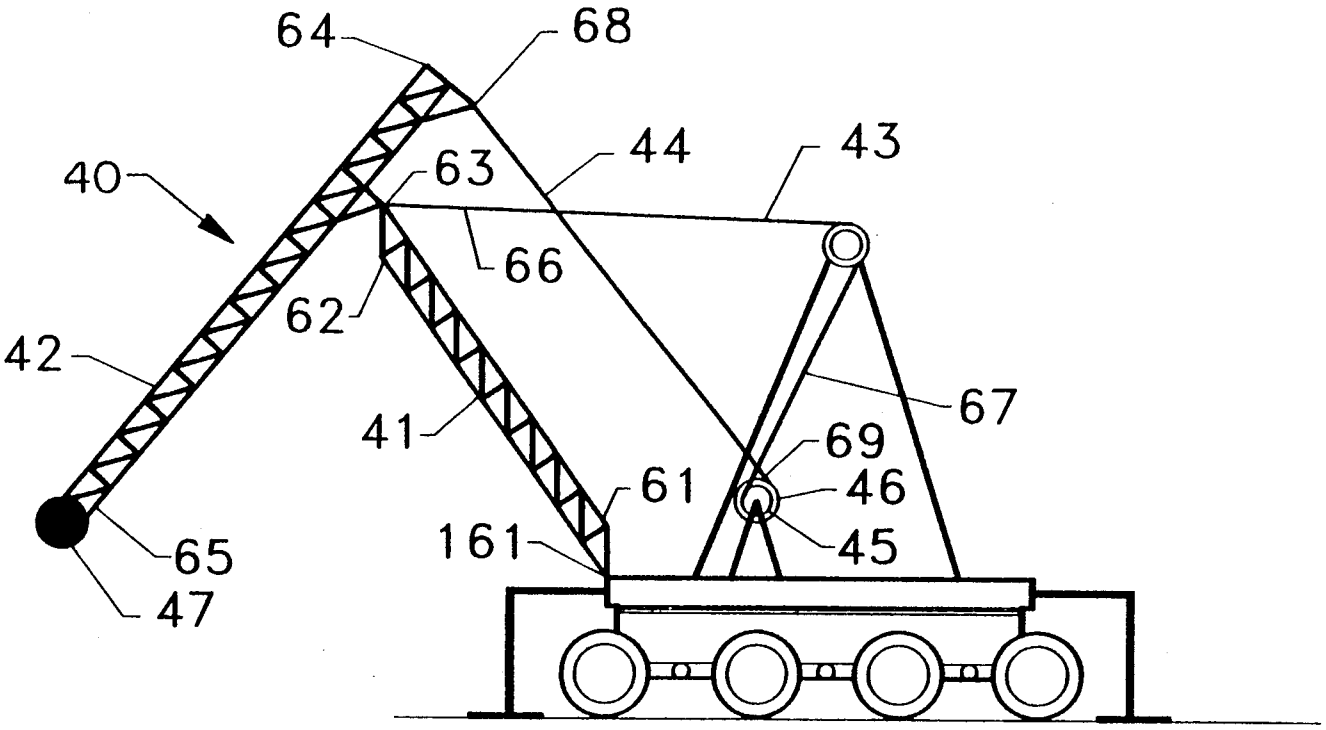
FIG. 4 is a side view of a counter-balancing means of the present invention.

As disclosed in FIG. 4, counter-balancing means 40 comprises a first boom 41, a second boom 42, a first cable 43, a second cable 44, a first winding mechanism 45, a second winding mechanism 46, and a counterweight 47. First boom 41 has a first end 61 and a second end 62. The first end 61 joins foundation 50 at connection 161, and the second end 62 joins the second boom 42 at joint 63. Connection 161 and joint 63 each allow first boom 41 and second boom 42 to rotate about generally horizontal axes, thereby allowing the counterweight to be moved in both rotational and translational manners. Preferably, joint 63 is located midway along the length of second boom 42.

The first cable 43 has a working end 66 and a winding end 67. Working end 66 attaches to the second end 62 of the first boom 41, and winding end 67 attaches to the first winding mechanism 45. First winding mechanism 45 attaches to foundation 50. The second or cable 44 has working end 68 attached to a first end 64 of the second boom and a winding end 69 attached to the second winding mechanism 46. Second winding mechanism 46 attaches to foundation 50. The counterweight 47 attaches to a second end 65 of the second boom. Counterweight 47 preferably is made from regolith or any other readily available planetary material.

Figure 5:
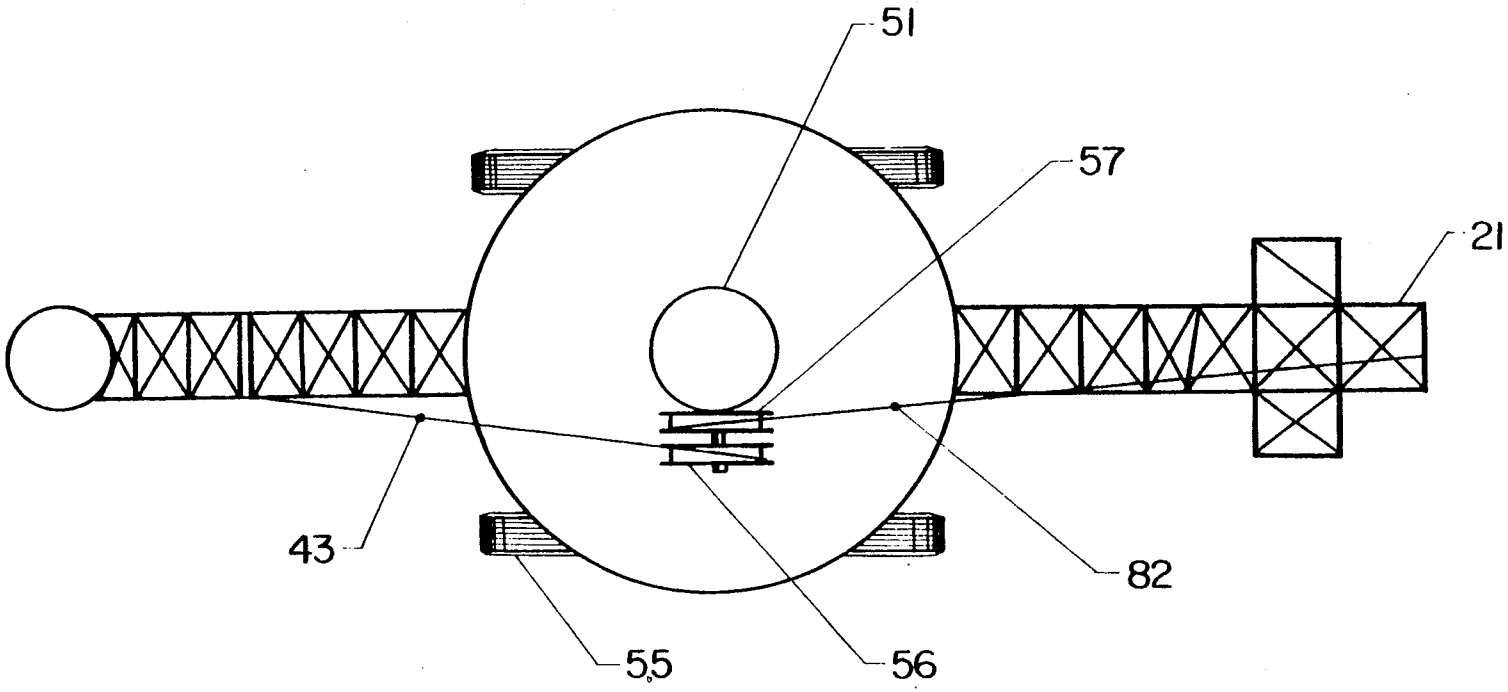
FIG. 5 is a top view of the foundation showing two pulleys.

FIG. 5 reveals a first pulley 56 located at the top 51 of foundation 50. The first pulley 56 guides and supports the tensional forces transmitted through the first cable 43.

Figure 6:
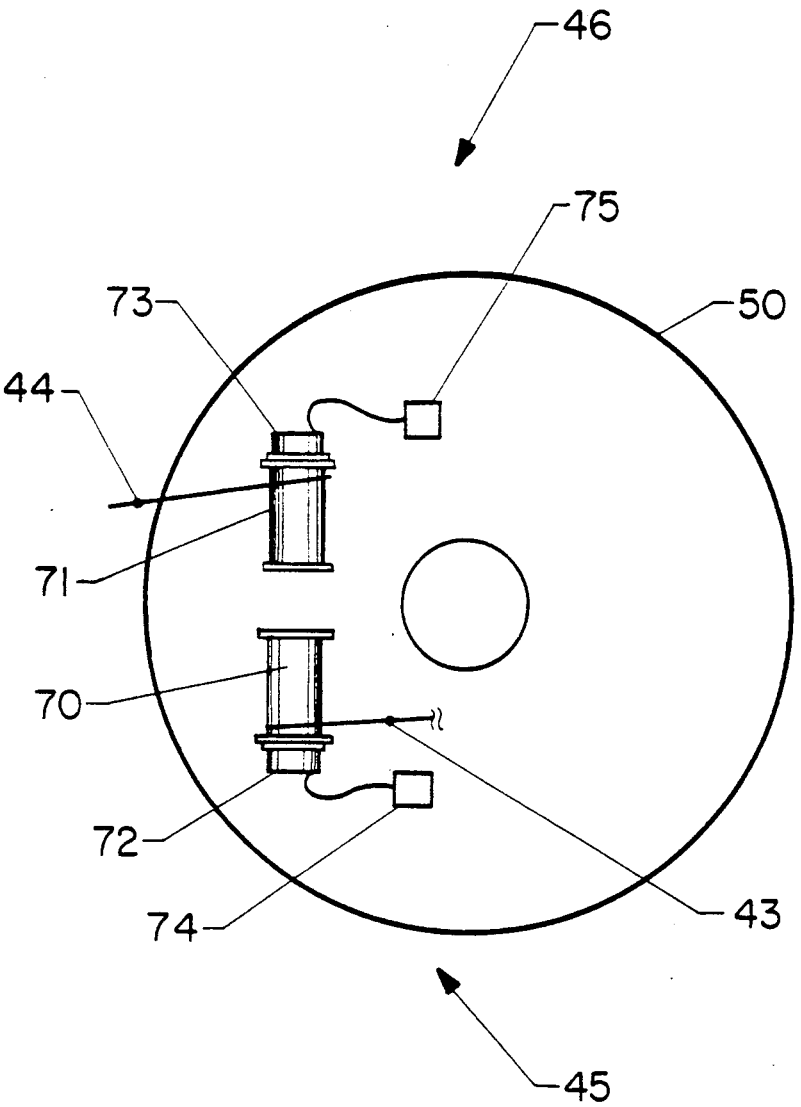
FIG. 6 is a top view of two winding mechanisms of the present invention.

As demonstrated in FIG. 6, the first winding mechanism 45 comprises a first winding 70, a first motor 72, and a first control 74. First control control 74 sends a signal to drive the first or motor 72. Motor 72 thereby rotates the first winding drum 70, which has the cable 43 attached. First winding drum 70 winds cable 43 to a predetermined position, thereby allowing the first boom to be raised or lowered.

FIG. 6 also shows that the second winding mechanism 46 comprises a second winding drum 71, a second motor 73, and a second control device 75. Operation of the second winding mechanism 46 is similar to operation of the first winding mechanism 45. Second control device 75 drives the motor 73, which in turn rotates second winding drum 71. Second winding drum 71 winds attached cable 44 to a predetermined position, thereby allowing the second boom 42 to be positioned. The first and second control device 74 and 75 thus enable accurate positioning of counterweight 47 to offset the overturning moment which arises during the lifting of heavy payloads.

Figure 7:
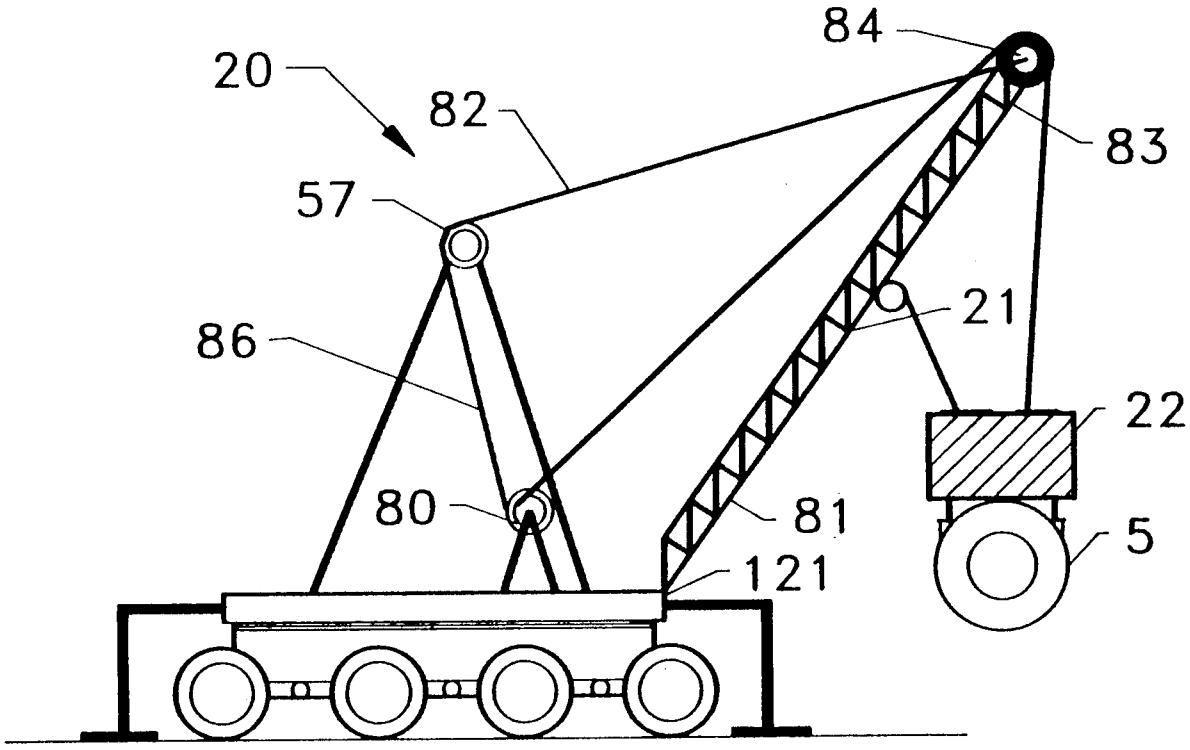
FIG. 7 is a side view of the lifting means of the present invention.

As illustrated in FIG. 7, lifting means 20 further comprises third boom 21, a third cable 82, and a third winding mechanism 80. A first end 81 of third boom 21 joins foundation 50 at connection 121. Connection 121 allows third boom 21 to rotate about a generally horizontal axis. Cable 82 has a working end 84 attached to a second end 83 of third boom 21 and a winding end 86 attached to the third winding mechanism 80. The third winding mechanism 80 attaches to foundation 50.

FIG. 5 discloses a second pulley 57 located at the top 51 of foundation 50. The second pulley guides and supports the tensional forces transmitted through cable 82.

Figure 8:
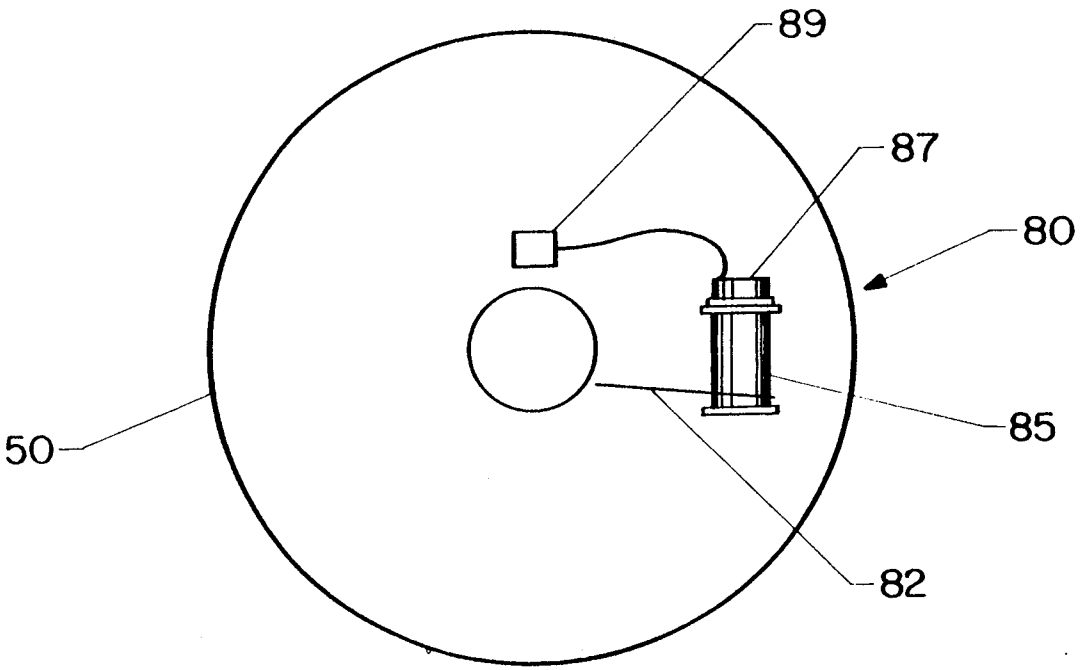
FIG. 8 is a top view of a third winding mechanism of the present invention.

As revealed in FIG. 8, the third winding mechanism 80 comprises a third winding drum 85, a third motor 87, and a third control device 89. Operation of the third winding mechanism 80 is similar to operation of the first and second winding mechanism. Third control device 89 drives the motor 87, which in turn rotates third winding drum 85. Third winding drum 85 winds attached cable 82 to a predetermined position, thereby allowing the third boom 21 to be raised or lowered as desired. Third control device 89 thus enables positioning of the payload 5.

As respectively shown in FIGS. 9(A), 9(B) and 9(C), lifting means 20 preferably further comprises three winding mechanisms 90A, 90B, and 90C. Each winding mechanism 90A, 90B, and 90C respectively comprises a winding drum 91A, 91B, and 91C, a motor 93A, 93B, and 93C, and regulator 95A, 95B, and 95C. Operation of each winding device is similar to operation of the three winding mechanism. Each regulator 95A, 95B, and 95C respectively drives each motor 93A, 93B, and 93C, which respectively rotates each winding drum 91A, 91B, and 91C. Each winding drum 91A, 91B, and 91C respectively winds attached cables 24A, 24B, and 24C to a predetermined position, thereby allowing precise and autonomous positioning of the payload 5.

FIG. 2 discloses a third pulley 29 located at the second end 83 of third boom 21. The third pulley 29 guides and supports the suspension forces transmitted through one of three suspension cables 24A, 24B and 24C. Preferably, the cable guided by pulley 29 is the same cable that is supporting approximately 90% of the load.

Figure 10:
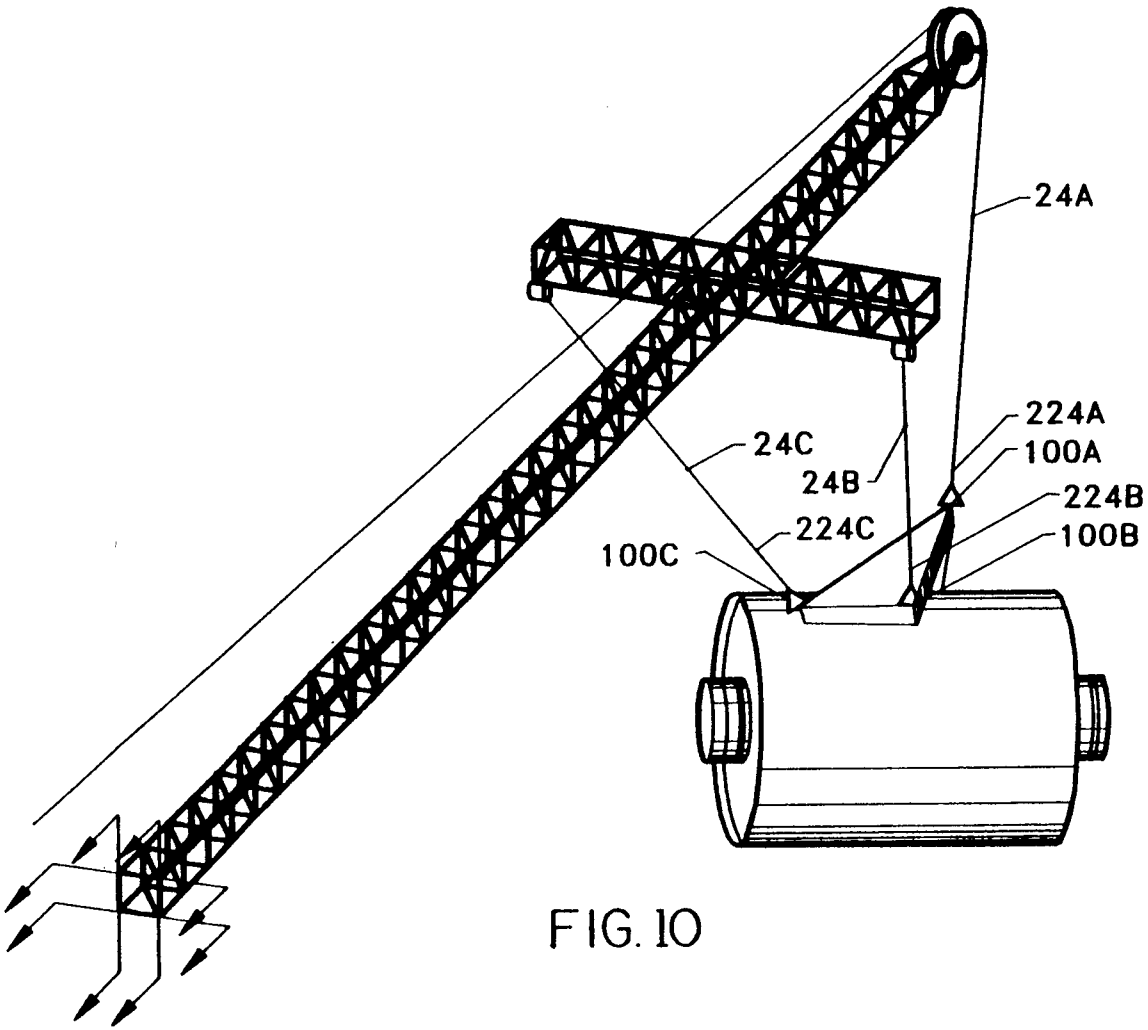
FIG. 10 is a perspective view of an end effector of the present invention.

As illustrated in FIG. 10, the end effector comprises three positioning means 100A, 100B, and 100C. Each working end 224A, 224B and 224C of cables 24A, 24B, and 24C respectively attaches to positioning means 100A, 100B, and 100C at points 31A, 31B, and 31C. Each positioning means 100A, 100B, and 100C further provides a plurality of attaching points 31A, 31B, and 31C. The three positioning means thereby provide an infinite array of suspension cable attachments and enable the crane 10 to be used for a range of payloads having different centers of mass.

Figure 11:
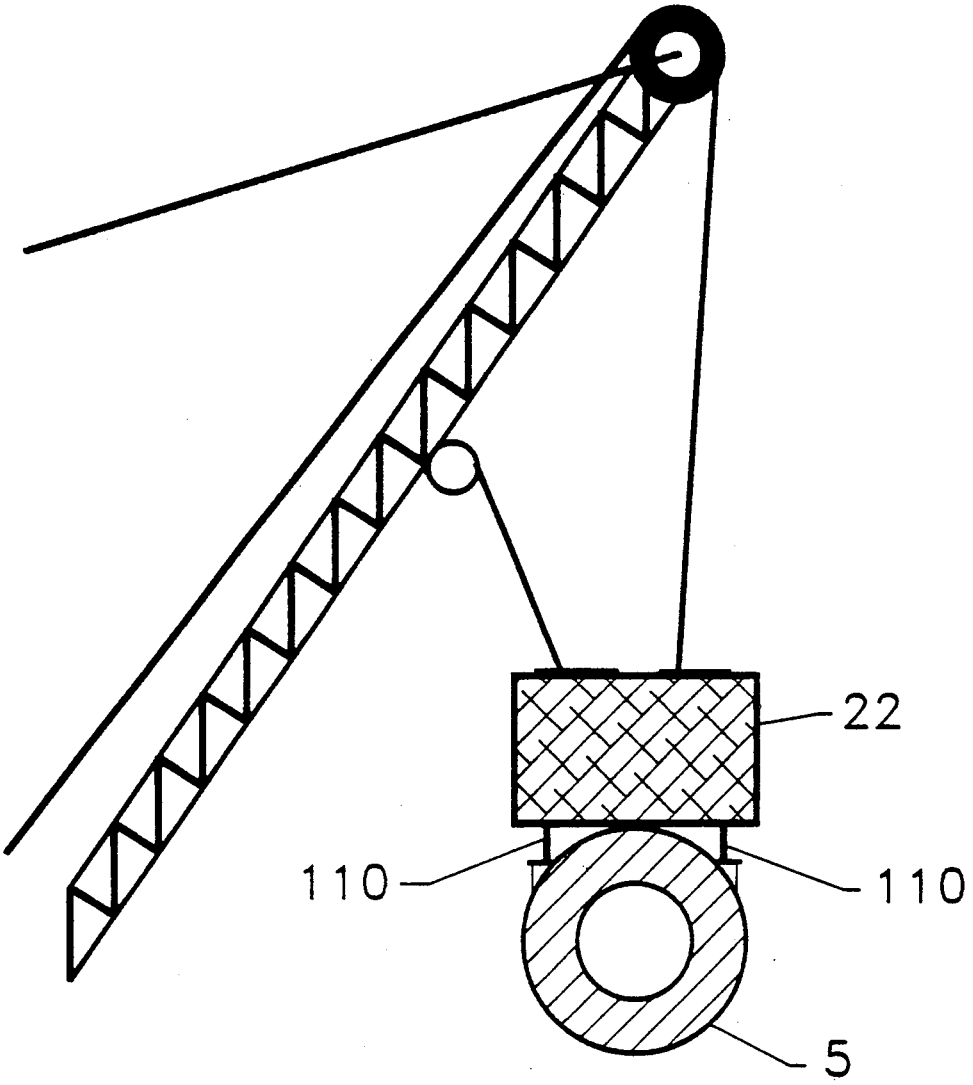
FIG. 11 is a side view of an end effector of the present invention.

As shown in FIG. 11, the end effector comprises an attaching means 110. The attaching means 110 may operate automatically to grasp and hold the payload 5.

Crane 10 may use a number of different end effectors to handle different size and types of payloads. Additionally, a robot could be attached to the end effector, enabling the crane to provide a mobile and remote, stable platform for robotic operations. Further, a vibrating bucket could be attached to the end effector, allowing excavating operations to be performed.

What is claimed is:

1. An apparatus for hoisting and moving a payload having a center of mass, comprising:

(a) a lifting means comprising an end effector and three cables;

each cable having a winding end and a working end;

each winding end attached to a different point of the lifting means; and each working end attached to a different point of the end effector such that the three cables each lift the payload and converge toward the center of mass of the payload;

(b) a counter-balancing means comprising a first boom, a first cable, a second cable, a first means for coiling, a second means for coiling, and a counterweight;

the first boom having a first end and a second end, the first end of the first boom rotatably joined to the foundation, the second end of the first boom rotatably joined to the second boom;

the second boom having a first end and a second end;

the first cable having a working end and a coiling end, the working end of the first cable attached to the second end of the first boom, the coiling end of the first cable attached to the first means for coiling;

the first means for coiling attached to the foundation;

the second cable having a working end and a coiling end, the working end of the second cable attached to the first end of the second boom, the coiling end of the second cable attached to the second means for coiling;

the second means for coiling attached to the foundation;

the counterweight being attached to the second end of the second boom;

(c) a foundation having a top and a bottom and two opposite ends;

the lifting means joined to one of the two opposite ends of the foundation; and the counter-balancing means joined to the opposite end which is not joined to the lifting means; and (d) a transporting means connected to the bottom of the foundation, the transporting means providing for transportation of the apparatus.

2. An apparatus according to claim 1, further comprising:

a first pulley attached to the top of the foundation the first pulley guiding the first cable.

3. An apparatus according to claim 2, wherein the first means for coiling further comprises a first coiling drum, a first rotating means, and a first control means, the first control means driving the first rotating means such that the first coiling drum rotates and coils the first cable to a predetermined position, whereby the first boom may be raised or lowered.

4. An apparatus according to claim 3, wherein the second means for coiling further comprises a second coiling drum, a second rotating means, and a second control means, the second control means driving the second rotating means such that the second coiling drum rotates and coils the second cable to a predetermined position, whereby the second boom may be positioned as desired.

5. An apparatus according to claim 4, wherein the lifting means further comprises a third boom, a third cable, and a third means for coiling;

the third boom having a first end and a second end;

the first end of the third boom joined to the foundation;

the third cable having a working end and a coiling end, the working end of the third cable attached to the second end of the third boom, the coiling end of the third cable attached to the third means for coiling;

the third means for coiling attached to the foundation.

6. An apparatus according to claim 5, further comprising:

a second pulley attached to the top of the foundation, the second pulley guiding the third tension means.

7. An apparatus according to claim 6, wherein the third means for coiling further comprises a third coiling drum, a third rotating means, and a third control means, the third control means driving the third rotating means such that the third coiling drum rotates and coils the third cable to a predetermined position, whereby the third boom may be raised or lowered.

8. An apparatus according to claim 7, wherein the lifting means further comprises three winding means;

each winding means comprising a winding drum, a turning means, and a regulating means;

each winding end of each suspension means attached to a different winding drum;

each regulating means driving a different turning means such that each winding drum rotates and winds the attached suspension means to a predetermined position, whereby precise and autonomous positioning of the payload is provided.

9. An apparatus according to claim 8, wherein the end effector further comprises three positioning means;

each working end of each suspension means attached to a different positioning means, the positioning means providing a plurality of points of attachment for each suspension means.

10. An apparatus according to claim 9, wherein the end effector further comprises attaching means such that the end effector grasps the payload.

11. An apparatus according to claim 8, further comprising:

a third pulley means attached to the second end of the third boom, the third pulley means guiding one of the three suspension means.

12. An apparatus for hoisting and moving a payload having a center of mass, comprising:

a lifting means; and a counter-balancing means comprising a first boom, a first cable, a second cable, a first means for coiling, a second means for coiling, and a counterweight;

the first boom having a first end and a second end, the first end of the first boom rotatably joined to the foundation, the second end of the first boom rotatably joined to the second boom;

the second boom having a first end and a second end;

the first cable having a working end and a coiling end, the working end of the first cable attached to the second end of the first boom, the coiling end of the first cable attached to the first means for coiling;

the first means for coiling attached to the foundation;

the second cable having a working end and a coiling end, the working end of the second cable attached to the first end of the second boom, the coiling end of the second cable attached to the second means for coiling;

the second means for coiling attached to the foundation;

the counterweight being attached to the second end of the second boom.

13. An apparatus according to claim 12, wherein the lifting means further comprises an end effector and three cables;

each cable having a winding end and a working end;

each winding end attached to a different point of the lifting means; and each working end attached to a different point of the end effector means such that the three cables each lift the payload and converge toward the center of mass of the payload.

14. An apparatus according to claim 13, further comprising:

a foundation having a top and a bottom and two opposite ends;

the lifting means joined to one of the two opposite ends of the foundation; and the counter-balancing means joined to the opposite end which is not joined to the lifting means.

15. An apparatus according to claim 14, further comprising:

a transporting means connected to the bottom of the foundation, the transporting means providing for transportation of the apparatus.

* * * * *